US005368188A

United States Patent [19]

Twardowski

[11] Patent Number: 5,368,188

[45] Date of Patent: Nov. 29, 1994

[54] FOLDED PRODUCT WITH INDICATOR FOR FACILITATING REMOVAL

[75] Inventor: Harvey J. Twardowski, Wauwatosa, Wis.

[73] Assignee: Meridian Industries, Inc., Milwaukee, Wis.

[21] Appl. No.: 122,929

[22] Filed: Sep. 17, 1993

[51] Int. Cl.[5] ..... A47K 10/24

[52] U.S. Cl. ..... 221/50; 221/2; 221/38; 221/47; 221/48; 206/494

[58] Field of Search ..... 221/38, 33, 2, 22, 45, 221/46, 47, 48, 50, 56, 63, 303, 309, 312 R; 206/494, 812

[56] References Cited

U.S. PATENT DOCUMENTS

| | | | |
|---|---|---|---|
| 1,820,259 | 8/1931 | Wandel . | |
| 1,935,970 | 11/1933 | Wooster et al. . | |
| 2,080,729 | 5/1937 | McConnell | 221/50 |
| 2,085,882 | 7/1937 | Wandel . | |
| 2,195,622 | 4/1940 | Fourness et al. | 221/63 |
| 2,529,853 | 11/1950 | Taggart | 221/63 |
| 3,207,360 | 9/1965 | Scott | 221/48 |
| 3,784,056 | 1/1974 | Spruyt et al. | 221/63 |
| 3,819,043 | 6/1974 | Harrison | 221/63 X |
| 4,064,880 | 12/1977 | Logan | 221/47 X |
| 4,161,249 | 7/1979 | Dashow . | |
| 4,735,317 | 4/1988 | Sussman et al. | 221/46 X |
| 4,863,064 | 9/1989 | Dailey, III | 221/48 |
| 4,865,221 | 9/1989 | Jackson et al. | 221/48 |
| 4,901,663 | 2/1990 | De Luca . | |
| 5,148,572 | 9/1992 | Wells et al. . | |

FOREIGN PATENT DOCUMENTS

| | | | |
|---|---|---|---|
| 253308 | 1/1988 | European Pat. Off. | 221/50 X |

*Primary Examiner*—Robert P. Olszewski
*Assistant Examiner*—Dean A. Reichard
*Attorney, Agent, or Firm*—Foley & Lardner

[57] ABSTRACT

The present invention relates primarily to folded fabric products, such as baby wipes, hand wipes, fabric softener sheets, and the like. Folded individual sheets include a visual indicator, such as a line of contrasting color, at the location of the sheet which should be removed first by the user. In a preferred example, folded baby wipes include moistened, non-woven fabric, folded in such a way that the visual indicator is located at the top of each folded sheet. A plurality of sheets can be stacked in a tub or container. Removal of one sheet will present the indicator of the next lower.

16 Claims, 3 Drawing Sheets

FOLDED PRODUCT WITH INDICATOR FOR FACILITATING REMOVAL

BACKGROUND OF THE INVENTION

1. Field of the Invention

The present invention relates generally to the art of folded sheets, such as non-woven sheets used for such applications as baby wipes and fabric softener sheets. More specifically, the present invention relates to a system for facilitating removal of individual sheets from a stack of folded sheets held within a container, such as a tub. Still more specifically, the present invention relates to the placement of a visual indicator on folded sheets, the indicator directing the user to a specific location of the stack for grasping and removing a single sheet.

2. Description of the Prior Art

A number of fabric products are currently being sold which include a stock of individually folded sheets. Several well-known examples are folded, moistened baby wipe sheets and folded fabric softener sheets. In both of these examples, the sheets are made from non-woven fabric, but in the context of this review of the prior art and for purposes of this specification, the term "fabric sheet" should be taken to include woven and non-woven sheets made from materials such as cellulosic materials.

Typical baby wipe sheets are stacked in a tub or other container having a removable and replaceable top, giving access to the contents. The plurality of sheets are moistened and include a generally rectangular base portion and a pair of flaps which are folded on opposite sides of the base portion. Such products have a uniform color, and it is difficult for the user of the product to readily pick up an edge of one of the folds to remove a single moistened wipe from the container.

Typically, the person using such a product has one hand occupied and it becomes frustrating to fumble with the stack of sheets in attempting to pick up one wipe at a time. It is common for a user to pick up more than a single sheet because of the tendency to grasp any portion of the upper sheet between thumb and finger. Unless the user grasps only the edge of one flap, there will be a tendency to grasp more than the thickness of one sheet and to lift a plurality of sheets. Similar problems are encountered when using folded sheets of fabric softener, or in other products such as hand wipes and the like.

Indicators of various types have been used with fabric products in the past. For example, in U.S. Pat. No. 1,820,259, issued Aug. 25, 1931 to Wandel for "Tissue Pad," rounded corners of a pad of folded tissue are compressed together for the dual purpose of causing the sheets to adhere to one another and to give a certain amount of stiffness to the pad where it is to be gripped by the user. In Wandel's Jul. 6, 1937 U.S. Pat. No. 2,085,882 for "Dispensing Package for Cellulose Tissue Sheets," a different approach is used, i.e. hemming together two superimposed sheets of tissue and separately folding the sheets along longitudinal lines in such a way that the hem will lie intermediate the folds. In this manner, the hem can be readily seen and instinctively grasped by the user.

Visual indicators have been used in other fabric applications. In one instance, described in U.S. Pat. No. 5,148,572, issued Sep. 22, 1992 to Wells et al. for "Video Game Console and Cartridge Cleaning Kit," the cleaning card is marked with the words "CLEAN" and "DRY" at opposite ends to indicate the wet and dry ends of the wand.

Several patents describe the use of indicators on rolls, such as rolled towels or rolled toilet tissue, to signify that the roll is almost depleted. See, for example, the roll depletion visual indicators of U.S. Pat. No. 4,901,663, issued Feb. 20, 1990 to De Luca for "Method of Indicating Towel Roll Depletion"; U.S. Pat. No. 1,935,970, issued Nov. 21, 1933 to Wooster et al. for "Indicating Means"; and U.S. Pat. No. 4,161,249, issued Jul. 17, 1979 to Dashow for "Web Product With Marker and Method of Manufacture."

While roll depletion indicators have been described in the aforementioned prior art and whereas certain tissue products have been joined together in such a way as to provide an indication of the area to be grasped, no teaching of the prior art has indicated a cure for the fabric dispensing problems described above. Accordingly, a solution to that problem would represent a substantial advance in the art.

SUMMARY OF THE INVENTION

The present invention features a visual indicator for fabric sheets which are stacked, one on top of the other, wherein the indicator facilitates removal of one sheet at a time.

The present invention further features a visual indicator in a stack of folded sheets, wherein the indicator is provided along one edge of a fold in situations where the designed removal technique is to lift a flap and pull it to remove the sheet from the stack.

In the most preferred form of the invention, the present invention features a folded stack of moistened fabric sheets, such as baby wipe sheets, wherein a visual indicator is provided along one edge of a flap to facilitate easy and efficient removal of one sheet at a time.

How the features of the present invention are accomplished will be described in the following detailed description of the preferred embodiment, taken in conjunction with the drawings. Generally, however, the features are accomplished by providing a plurality of individual sheets of fabric which are marked with a suitable visual indicator, such as, for example, a line of contrasting color. The indicator will be placed at the location where the user should grasp the sheet for removal. In the most preferred embodiment, the visual indicator is provided at the upper surface of a flap of folded fabric material, the top flap extending toward the centerline of a generally rectangular tub. One preferred way of providing the indicator will be described in the following detailed description. However, other ways in which the features of the invention may be accomplished will be readily apparent to those skilled in the art after the specification is read and understood.

BRIEF DESCRIPTION OF THE DRAWINGS

In the various FIGURES, like reference numerals are used to indicate like components.

DETAILED DESCRIPTION OF THE PREFERRED EMBODIMENT

Before proceeding with the detailed description of the preferred embodiment of the present invention, several comments should be made about the general applicability and scope thereof. First, while moistened, folded baby wipes will be used for the illustrated embodiment, the present invention has much wider applicability and can be used for such products as hand wipes, fabric softener sheets and the like. The main criteria for determining the applicability of the present invention is the desirability of providing a visual indicator to the user of a product as to where to grasp a fabric sheet for removal from a stack.

Also, as mentioned previously, the invention may be applied to woven and non-woven fabric sheets, such as those of the cellulosic variety employed in making the products identified above. While most of such products will be made in a white color and the visual indicator will be of a contrasting color, the principles of the invention are readily adaptable to reverse situations. Some contrast is necessary to allow the user to readily determine where the uppermost sheet should be grasped.

With regard to the specific embodiment, a number of variations can be made for the contrasting solid line which extends the entire length of the product. For example, the line could be interrupted (a dashed line), or the line could be of a shape other than straight. For example, a wavy line could be used. Words could be used in place of a simple line, such as "lift here" imprinted on the fabric at the desired location and in a contrasting color.

Further, it should be understood at the outset that the present invention will not attempt to describe all the steps commonly used for making baby wipes, including the impregnation of cleansing solutions or the conversion of large rolls of fabric material into individually folded sheets. Such techniques, in and of themselves, are well known in this art and any of them may be selected for preparing the individual sheets which will contain the visual indicator of the present invention. One preferred technique will be described in general terms to provide background for the reader.

In connection with the visual indicator, a specific material will be identified as the printed indicator in the most preferred embodiment, but other materials which are acceptable from a health standpoint and which will not run in the liquid environment could be substituted therefor. Furthermore, the technique for printing the indicator on the fabric can be any known printing technique, such as rotogravure or flexographic printing.

Figure 1:
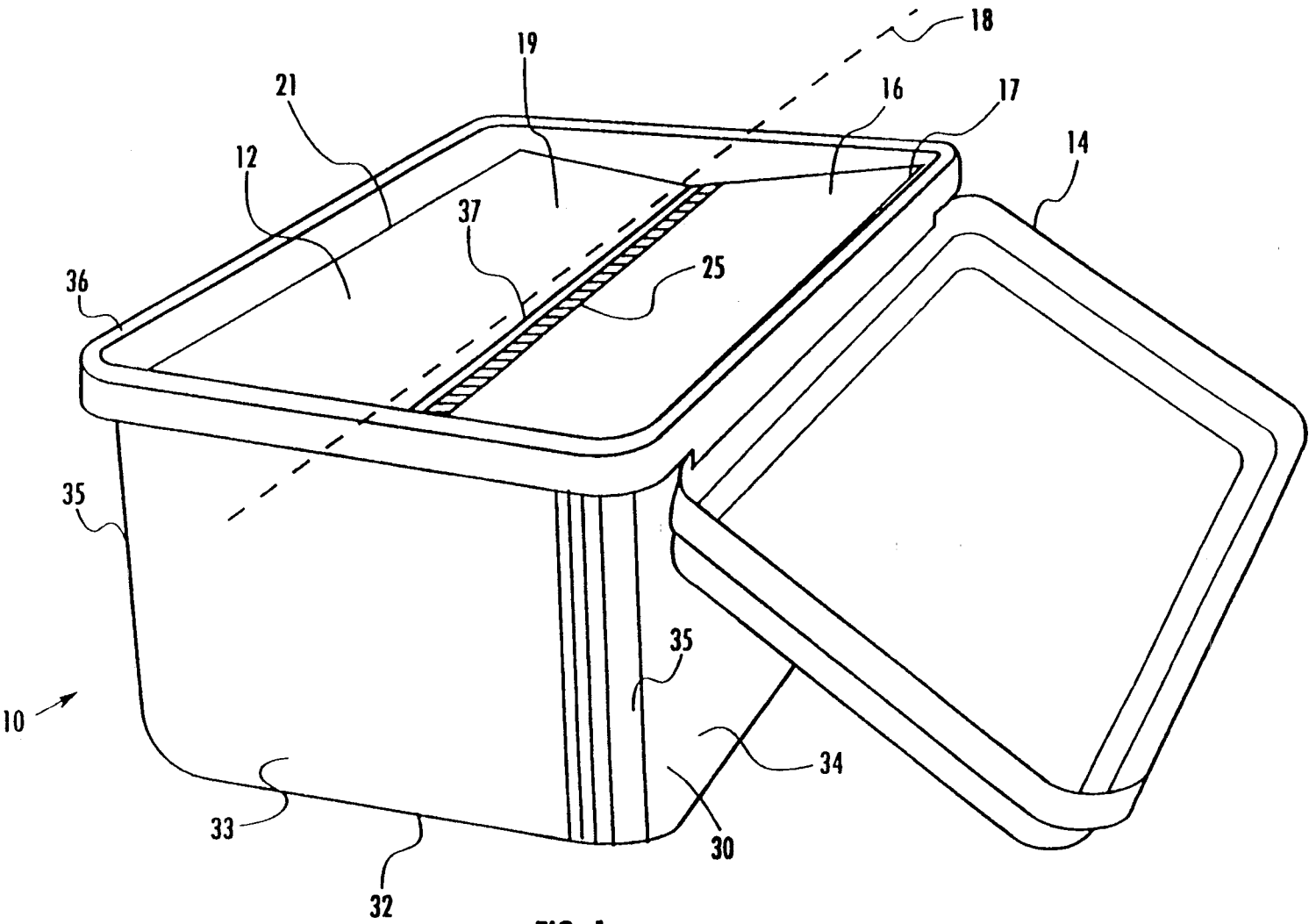
FIG. 1 is a perspective view of a container of folded baby wipe sheets incorporating the features of the present invention.
Figure 2:
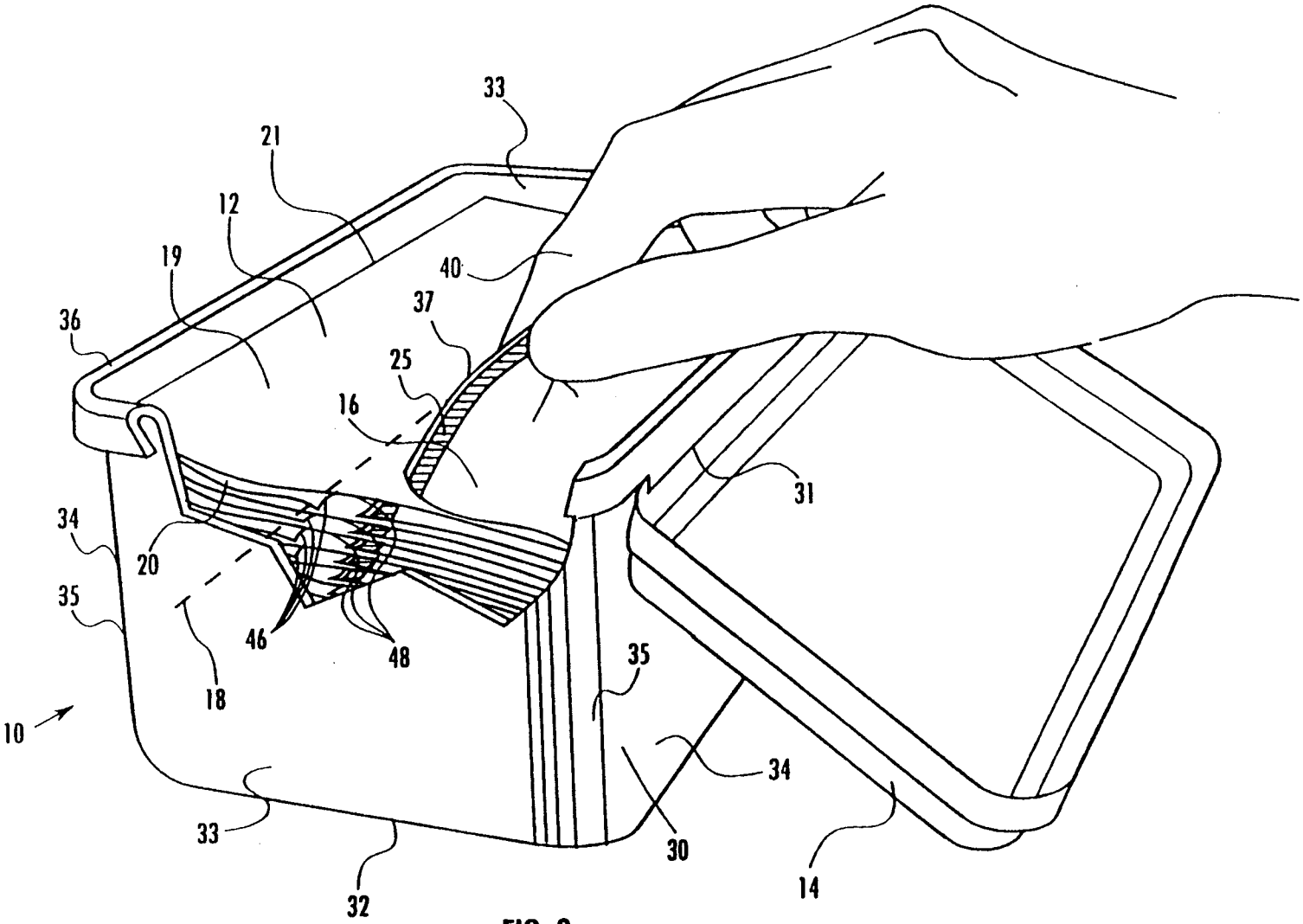
FIG. 2 is a perspective view having a cutaway portion to show in illustrative form a user grasping and removing the top sheet from the stack of sheets within the container.

Proceeding now to FIGS. 1 and 2, a container 10 is shown containing a plurality of baby wipe sheets 12. The container 10 has a hinged lid 14 which may be opened, as shown in FIG. 1 or closed to contain the wipes and prevent evaporation of the liquid.

Each sheet 12 includes three segments. A first segment or top flap 16 is folded from a fold line 17 toward an axial centerline shown by dotted line 18 of each sheet 12. A central second segment 19 is connected to first segment 16 and is generally planar and rectangular, lying at least partially beneath first segment 16. Second segment 19 extends across approximately the entire inner area of container 10 and joins a third segment 20 along a second fold line 21. Third segment 20 is a flap that preferably extends beneath second segment 19 when sheet 12 is in its folded configuration. In other words, sheet 12 is folded in a "Z" configuration if viewed from one end.

A visual indicator 25 is shown as a stripe extending along sheet 12 adjacent the free edge on first segment 16 and generally parallel with axial centerline 18. In a most preferred embodiment, the line is between $\frac{1}{8}$ and 3/16 inches wide and may be in the color blue for use with white wipe sheets 12. As mentioned previously, the color, as well as the size and shape, of the indicator is not critical to the scope of the invention.

The stack of wipe sheets 12 may be made in a variety of different ways, one of which will be generally described. The material of which wipe sheets 12 are made is manufactured on a machine in 100 to 140 inch wide webs. The material is then slit into approximately $42\frac{1}{2}$-inch wide rolls. These rolls are preferably placed on a printing press so that visual indicator 25 may be applied. In the most preferred embodiment, a line is printed approximately every $8\frac{1}{2}$ inches along the roll.

The $42\frac{1}{2}$-inch wide rolls are then placed on an unwind stand and run through a series of slitter knives and rollers which cut the material approximately every $8\frac{1}{2}$ inches in close proximity to the indicator lines running along the length of the web. The $8\frac{1}{2}$-inch segments are then wound into rolls on separate cores.

The series of $8\frac{1}{2}$-inch rolls are put on a special processing machine which includes seven or eight unwind shafts. Each roll is mounted so the indicator line is on the bottom side of the web. The web travels over the top of the machine, through the wet-out section, and down through formers that fold the sheet with the starting line facing up. A cutter cuts each sheet to approximately 7 inches and the desired number of folded sheets are stacked on top of one another in an appropriate container. All of the towels or sheets in each container have the indicator line located at the top and along the general center of the container so that as each sheet 12 is removed, the successive sheet 12 will show its visual indicator 25.

Referring specifically to FIG. 2, container 10 is shown in the open position. Preferably, container 10 includes a tub portion 30 to which is attached lid 14 along a hinge 31. Tub 30 preferably includes a bottom wall 32, a pair of end walls 33, and a pair of side walls 34. End walls 33 and side walls 34 extend generally upwardly from bottom wall 32 and are joined to one another along a plurality of edges 35 to form tub 30. A flange 36 is disposed about the perimeter of tub 30 on the end opposite bottom wall 32 and is configured for mating engagement with lid 14 when lid 14 is moved to a closed position.

As illustrated by the cutout portion in FIG. 2, the plurality of sheets 12 are preferably folded in a Z-shape configuration and stacked on top of one another in tub 30. As discussed above, sheets 12 may be wetted with a cleansing solution, such as an aqueous soap solution containing fragrances and skin softening agents, to facilitate the cleaning action of the sheets when they are used. The wetting of sheets 12 makes it more difficult for a user to select and pick up an individual sheet unless that user can separately grasp top flap 16. Thus, indicator 25 will direct a user's fingers 40 to an outer edge 37 of first segment 16 so first segment 16 may be pulled upwardly and the uppermost single sheet 12 may be lifted from tub 30. Edge 37 is disposed over central second segment 19 generally towards the axial centerline 18 of the sheet.

Figure 3:
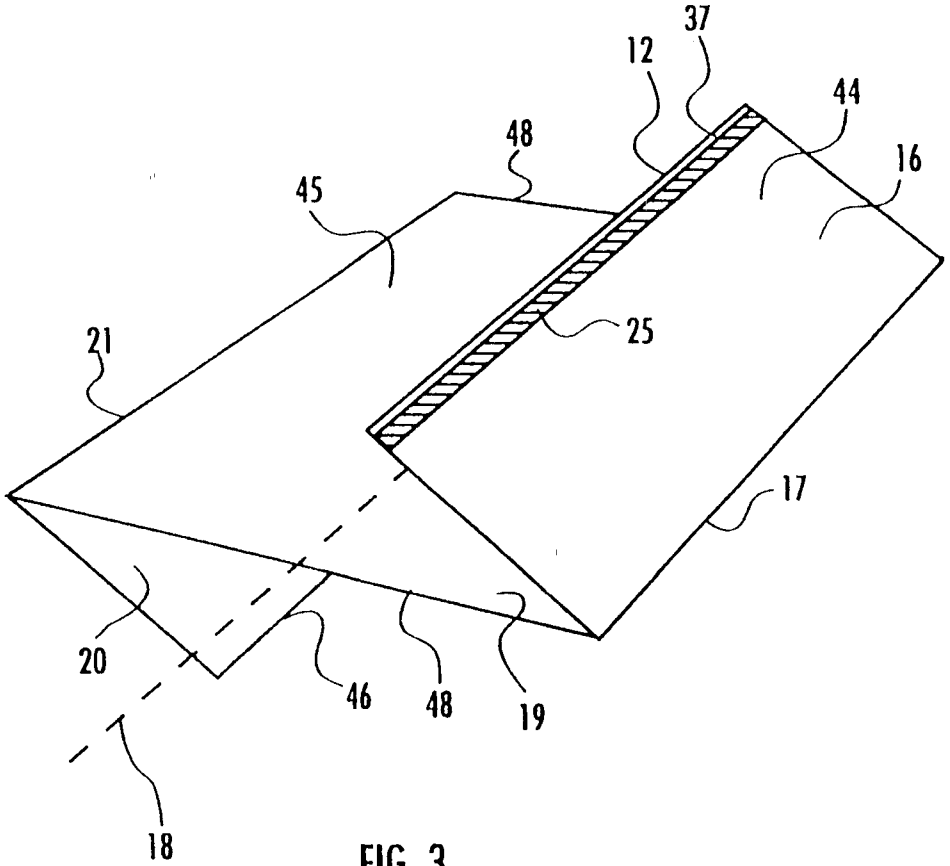
FIG. 3 is a perspective view of a single sheet.

As illustrated in FIG. 3, each wipe sheet 12 includes a first surface 44 and a second surface 45 opposed to first surface 44. The periphery of each sheet 12 is defined by edge 37 and a parallel edge 46 that are each approximately parallel with first fold line 17 and second fold line 21, and a second pair of generally parallel edges 48 which are perpendicular to edges 3,7 and 46. If sheet 12 is unfolded and laid out flat, the distance between edge 37 and edge 46 is approximately 8–9 inches and most preferably approximately 8½ inches, while the distance between edges 48 is approximately 6–8 inches and most preferably approximately 7 inches. However, the size and shape of sheets 12 may be varied dramatically as desired for a particular application.

Sheet 12 preferably is folded along two lines 17 and 21, although it could be folded along one fold line or along multiple fold lines, depending on the size of the sheet 12 and the size of container 10. However, there should always be at least one fold line so that first segment 16 may be folded over the top of the remaining sheet 12 for easy grasping by a user. Visual indicator 25 is thus placed on first surface 44 of first segment 16 in close proximity to edge 37 of first segment 16.

In FIG. 3, the most preferred form of visual indicator 25 is illustrated. This visual indicator is a line disposed generally parallel with edge 37 and extending between edges 48. At least part of visual indicator 25 is preferably within approximately ¼-inch of edge 37. In this most preferred embodiment, the visual indicator line 25 should be an ink which does not break down, dissolve, or smudge when sheet 12 is wetted with a cleansing solution. The type of ink or dye used may vary depending on factors such as the method of printing, the formulation of the cleansing solution, or whether an aqueous solution is used. However, in most solutions, the ink must be suitable for contact with human skin.

It will be understood that the foregoing description is of a preferred exemplary embodiment of this invention, and that the invention is not limited to the specific form shown. For example, the container may be made in a variety of shapes and sizes, the sheets may be made In a variety of shapes and sizes, the sheets may be dry or wetted, the visual indicator may be made of different colors or configurations, and the number of fold lines may be varied according to the particular application. These and other modifications may be made in the design and arrangement of the elements without departing from the scope of the invention as expressed in the appended claims.

What is claimed is:

1. A sheet stacking system for facilitating easy removal of individual sheets, the sheet stacking system comprising:

a container; and a plurality of folded sheets stacked within the container, each sheet having a top flap, the top flap further including a visible mark having a different color at least partially impregnating a portion of the top flap the visible mark being an integral part of the sheet and easily perceptible to a user to facilitate single sheet removal.

2. The sheet stacking system of claim 1, wherein the plurality of sheets are baby wipes wetted with a cleansing solution.

3. The sheet stacking system of claim 1, wherein the plurality of sheets are fabric softener sheets.

4. The sheet stacking system of claim 1, wherein the visible mark is a line having a different color than the sheet and extending in close proximity to and generally parallel with an edge of the top flap.

5. The sheet stacking system of claim 4, wherein the line is formed with a blue dye.

6. The sheet stacking system of claim 1, wherein the plurality of sheets are made from a non-woven fabric.

7. A sheet stacking system for facilitating easy removal of individual sheets, the sheet stacking system comprising:

a plurality of folded, wetted sheets arranged in a vertically stacked relationship, each sheet including a generally planar segment and a flap segment attached to the generally planar segment along a fold line; the flap segment being folded along the fold line over the top of the planar segment, the flap segment further including a visible mark deposited in proximity to an edge of the flap segment, the visible mark being of a different color than the flap segment and at least partially impregnating a portion of the flap segment, wherein as each sheet is grapsed by its flap segment in proximity to its visible mark and lifted from the plurality of sheets, a successive sheet is exposed having a similar visible mark deposited in proximity to an edge of its flap segment, each visible mark being integral with its corresponding sheet.

8. The sheet stacking system of claim 7, wherein the visible mark is a line extending along at least a portion of the edge.

9. The sheet stacking system of claim 8, wherein the line extends the entire distance along the edge.

10. The sheet stacking system of claim 8, further comprising a second flap segment attached to the planar segment along a second fold line opposite the first flap segment.

11. The sheet stacking system of claim 10, wherein the second flap segment is folded along the second fold line and is folded under the planar segment to provide the sheet with a Z configuration when folded.

12. The sheet stacking system of claim 10, further comprising a container for the plurality of sheets.

13. The sheet stacking system of claim 12, wherein the container includes a lid connected to the container by a hinge.

14. The sheet stacking system of claim 12, wherein each sheet is wetted with a cleansing solution.

15. A method for stacking sheets to facilitate easy removal of individual sheets, the method comprising the steps of:

forming a plurality of generally rectangular sheets, each sheet having four edges, a top surface and a bottom surface;

marking each sheet with a permanently visually perceptible indicator generally along one of the four edges, the visual indicator having a color which contrasts with the color of the sheet;

folding each sheet to form a flap, the visual indicator located on an outwardly exposed portion of the flap; and stacking the individual folded sheets on top of one another.

16. The method of claim 15, wherein the step of marking the sheet includes marking the sheet with a line of contrasting color generally parallel with the one edge.

* * * * *